US005163679A

United States Patent [19]

Lo

[11] Patent Number: 5,163,679

[45] Date of Patent: Nov. 17, 1992

[54] HOLLOW FILLED COMPOSITE RACKET SHAFT WITH RESTRICTED INTERMEDIATE PORTION

[76] Inventor: Kun N. Lo, No. 33, Hsan Ho Rd., Tan-Tzu Hsian, Taichung Hsien, Taiwan

[21] Appl. No.: 174,124

[22] Filed: Mar. 28, 1988

Related U.S. Application Data

[63] Continuation-in-part of Ser. No. 878,200, Jun. 25, 1986, abandoned.

[51] Int. Cl.[5] ..... A63B 49/02

[52] U.S. Cl. ..... 273/73 G; 273/735

[58] Field of Search ..... 273/73 R, 73 C, 73 G, 273/73 H, 73 J, 73 K, 29 H, 72 R, 72 A, 80 R, 75

[56] References Cited

U.S. PATENT DOCUMENTS

| | | | |
|---|---|---|---|
| 1,539,029 | 10/1924 | Surridge | 273/73 J |
| 4,549,736 | 10/1985 | Lotfy | 273/73 J |
| 4,565,371 | 1/1986 | Pawlicki et al. | 273/73 J |

FOREIGN PATENT DOCUMENTS

| | | | |
|---|---|---|---|
| 482164 | 3/1938 | United Kingdom | 273/73 C |
| 690270 | 4/1953 | United Kingdom | 273/80 B |
| 1321235 | 6/1973 | United Kingdom | 273/73 H |

OTHER PUBLICATIONS

*World Tennis Magazine;* "Racket Reviews", Nov. 1985, pp. 34–37.

*Primary Examiner*—Edward M. Coven
*Assistant Examiner*—William E. Stoll

[57] ABSTRACT

A composite racket frame includes a shaft constituted by a shell and a foamed core and having a portion of smallest cross-section substantially at an intermediate portion thereof relative to any other portion, the dimension of the cross-section of the portion being restricted only in a direction substantially perpendicular to the plane of the string web. The shaft further having two stepped width-increasing portions respectively extending from the smallest portion toward the throat section and the end of the shaft. The grip member of the shaft extends at least partly over the smallest cross-section portion, and the stepped width-increasing portions are stepped both on the outside and on the inside of the shell of the shaft.

2 Claims, 3 Drawing Sheets

HOLLOW FILLED COMPOSITE RACKET SHAFT WITH RESTRICTED INTERMEDIATE PORTION

This application is a Continuation-in-Part application of U.S. patent application Ser. No. 878,200 filed Jun. 25, 1986, which is now abandoned.

BACKGROUND OF THE INVENTION

This invention relates to a composite racket frame and particularly to a composite racket frame including a racket shaft which has a portion whose cross section is smaller than that of the remaining portions thereof, and also including two stepped width-increasing portions extending from both sides of the smallest cross-section portion and a grip portion which covers a part of the smallest cross-section of the shaft.

It has been known to provide a racket shaft or a golf club shaft with a central portion of restricted cross-section in order to provide maximum flexibility and resiliency through which the shock induced upon striking can be minimized. For example, U.K. Patent No. 482,164 discloses a hollow metal racket shaft which has a portion of smallest cross-section and two multi-stepped width-increasing portions on both sides of the smallest cross-section portion wherein a grip portion is provided to cover the end of the shaft which is restricted. U.K. Patent No. 389,353 discloses a hollow metal golf club shaft with a portion of smallest cross-section and two stepped width-increasing portions. This type of hollow metal shaft is liable to break at the smallest-cross section portion thereof and the resiliency that this shaft provides is still unsatisfactory.

SUMMARY OF THE INVENTION

An object of the invention is to provide a racket shaft having a portion of smallest cross-section and two stepped width-increasing portions extending on both sides of the smallest cross-section portion, wherein a grip portion is arranged to cover at least part of the smallest cross-section portion and wherein the shaft still possesses a substantial flexure due to the remaining uncovered part of the smallest cross-section portion.

Another object of the present invention is to provide a composite racket shaft having a fiber reinforced plastic shell and a foamed core which has a restricted portion of smallest cross-section with stepped width-increasing portions on both sides thereof and which can absorb shock more effectively than is possible for a metal shaft.

The present exemplary preferred embodiment will be described in detail with reference to the following drawings, in which;

DETAILED DESCRIPTION OF THE PREFERRED EMBODIMENT

Figure 1:
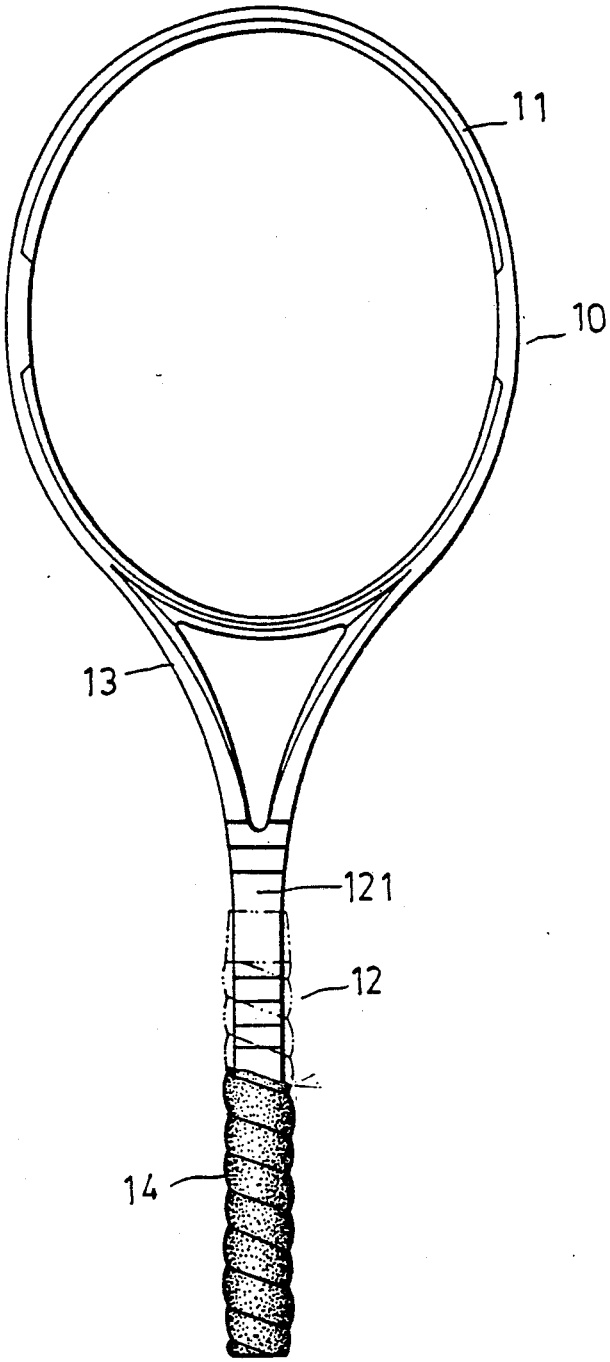
FIG. 1 is an elevation view of a racket frame according to the present invention viewed in a direction perpendicular to a plane of the looped head of the racket frame.
Figure 2:
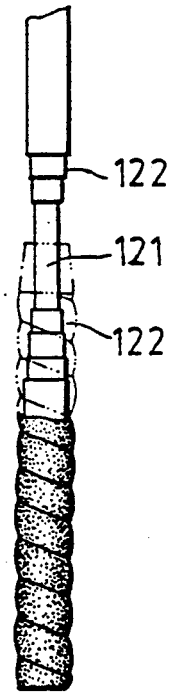
FIG. 2 is a fragmentary elevation view of the racket shaft of FIG. 1 viewed in a direction parallel to the plane of the looped head of the racket frame.

Referring to the drawings, a composite racket frame 10 of a racket shaft comprises in succession a looped head 11 for holding a string web (not shown), a hollow throat section 13 of substantially triangular shape and a shaft 12. A grip member 14 is provided substantially around the end portion of the shaft 12. The shaft 12 has a portion 121 of smallest cross-section substantially at the middle portion of the shaft relative to any other portion of the shaft, and the dimension of the cross-section of the smallest portion 121 being restricted only in a direction substantially perpendicular to the plane of the looped head 11. The shaft 12 further has two stepped width-increasing portions 122 on both sides of the portion 121 respectively extending from the smallest portion 121 toward the throat section 13 and from the smallest portion 121 toward the end of the shaft 12. The grip member 14 extends at least partly over the smallest cross-section portion 121.

Figure 3:
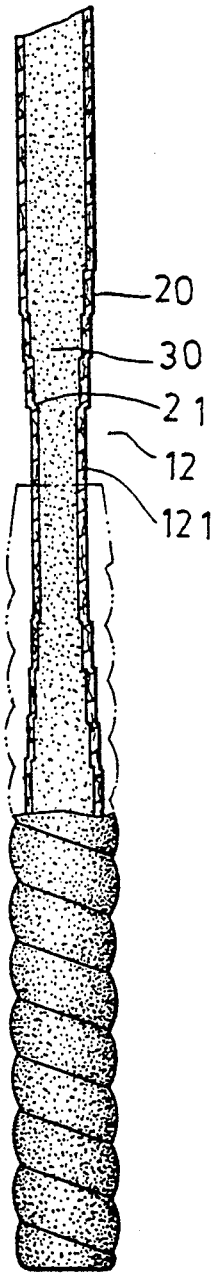
FIG. 3 is a sectional view of the racket shaft of FIG. 2.
Figure 4:
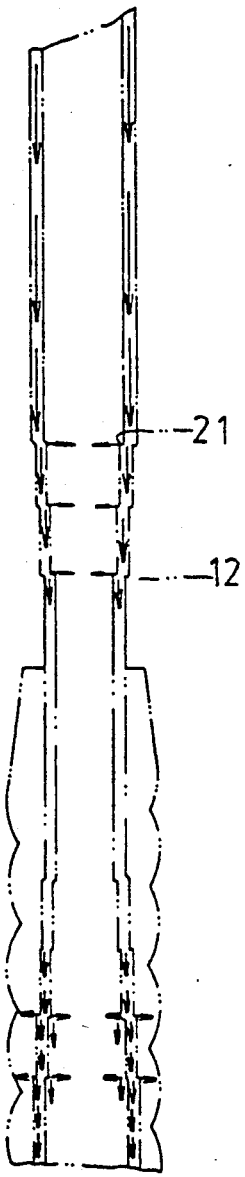
FIG. 4 is a view showing a more detail of the interior of the shaft.

The shaft 12 is constituted of a shell 20 made of a carbon fiber reinforced plastic material and a foamed core 30. The fabrication of shaft 12 can be carried out by a known method, such as by introducing a foamable material into a fiber reinforced plastic tube which is placed in a mold that can impart the shape of the racket shaft described above, and then heating the mold to cause the foamable material to pressurize the interior of the tube, thereby imparting a stepped shape on both the inside and outside of the shell. FIGS. 3 and 4 show the inner stepped surface 21 of the stepped portion 122 of the shaft 12 which is in close contact with the foamed core 30.

Figure 5:
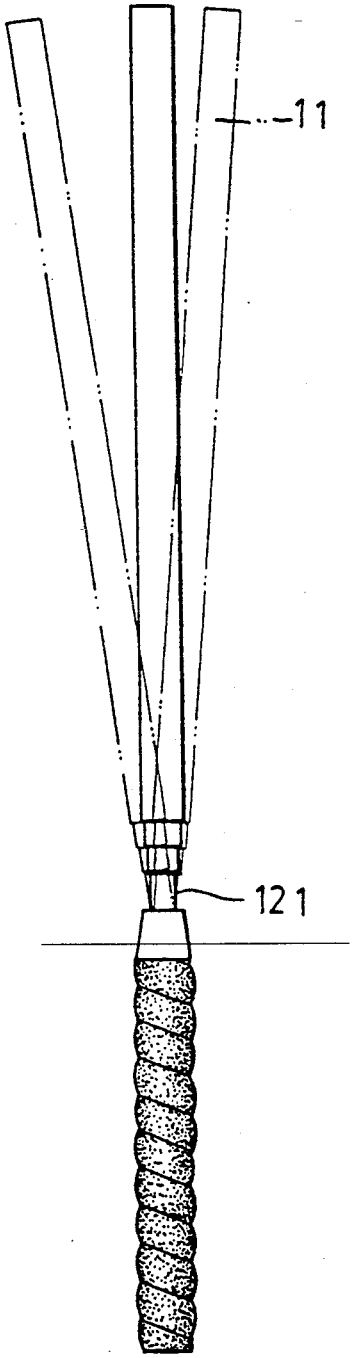
FIG. 5 shows how the racket shaft performs during the striking operation of the racket.

While the grip member 14 extends over a portion of the smallest portion 121 of the shaft, the remaining part of the portion 121 can still permit the shaft 12 to flex as shown in FIG. 5 so that the shaft exhibits increased resiliency and shock absorbency. It can be appreciated that the grip member 14 constructed according to the present invention can be coupled with the shaft 12 more firmly than in the conventional shaft.

With the invention thus explained, it is apparent that various modifications and variations can be made without departing from the scope of the invention. It is therefore intended that the invention be limited only as indicated in the appended claims.

What I claim is:

1. A composite racket frame comprising in succession a looped head for holding a string web, a frame portion defining a hollow throat section of substantially triangular shape and a tubular shaft, a grip member provided around said shaft at and near an end of said shaft, said shaft being composed of a fiber reinforced plastic shell and a foamed core, said shaft having an intermediate portion of smallest cross-section relative to any other portion of said shaft, the dimension of the cross-section of said portion being restricted only in a direction substantially perpendicular to the plane of said looped head, said shaft having two stepped width-increasing portions respectively extending toward said throat section and said end from said intermediate portion, said grip member extending at least partly over said smallest cross-section portion, said stepped width-increasing portions being stepped both on the outside and on the inside of said shell of said shaft.

2. A composite racket frame according to claim 1, wherein said substantially triangular shaped throat section includes divergent portions which turn outwardly to said looped head.

* * * * *

UNITED STATES PATENT AND TRADEMARK OFFICE

CERTIFICATE OF CORRECTION

PATENT NO. : 5,163,679

DATED : November 17, 1992

INVENTOR(S) : Kun N. Lo

It is certified that error appears in the above-identified patent and that said Letters Patent is hereby corrected as shown below:

On the title page, after the Assistant Examiner data, insert the following:

Attorney, Agent, or Firm - McGlew and Tuttle

Signed and Sealed this

Fifth Day of October, 1993

*Attest:*

*Attesting Officer*

Bruce Lehman

BRUCE LEHMAN

*Commissioner of Patents and Trademarks*